United States Patent [19]

Grant

[11] Patent Number: 4,997,142

[45] Date of Patent: Mar. 5, 1991

[54] PLASTIC REEL

[75] Inventor: Robert Y. Grant, Brookline, N.H.

[73] Assignee: Grant Plastics, Inc., Brookline, N.H.

[21] Appl. No.: 344,678

[22] Filed: Apr. 28, 1989

[51] Int. Cl.[5] ..... B65H 75/14

[52] U.S. Cl. ..... 242/118.4; 156/73.1; 156/309.6; 242/117; 242/118.6; 242/118.7

[58] Field of Search ..... 242/118, 118.4, 118.6, 242/118.61, 118.7, 117; 156/580.1, 73.1, 309.6

[56] References Cited

U.S. PATENT DOCUMENTS

| | | | |
|---|---|---|---|
| 3,334,841 | 8/1967 | Burhop | 242/118.61 |
| 3,606,195 | 9/1971 | Freeman et al. | 242/118.7 |
| 3,942,741 | 3/1976 | Hussar et al. | 242/118.7 |
| 3,966,139 | 6/1976 | Terpak | 242/118.7 |
| 4,259,419 | 3/1981 | Uba et al. | 156/73.1 X |
| 4,558,957 | 12/1985 | Mock et al. | 156/73.1 X |
| 4,606,783 | 8/1986 | Guest | 156/73.1 |
| 4,607,806 | 8/1986 | Yealy | 242/118.7 X |

FOREIGN PATENT DOCUMENTS

| | | | |
|---|---|---|---|
| 2202126 | 7/1973 | Fed. Rep. of Germany | 242/118.4 |
| 2258355 | 5/1974 | Fed. Rep. of Germany | 156/73.1 |

*Primary Examiner*—Joseph J. Hail, III

*Attorney, Agent, or Firm*—Hayes, Soloway, Hennessey & Hage

[57] ABSTRACT

A plastic reel or spool for fine magnet wire or the like is formed of two molded plastic pieces, preferably identical. Each piece preferably has a flange and a section of the core. The core sections have internal transverse lips which abut when the two pieces are assembled. The flanges have openings which permit the introduction of an appropriately dimensioned ultrasonic welding tool head to weld the abutting lip surfaces together.

5 Claims, 3 Drawing Sheets

PLASTIC REEL

BACKGROUND OF THE INVENTION

The invention relates to reels or spools, and more particularly to improved plastic reels or spools for storing fine magnet wire or monofilament, although other uses are contemplated. Such reels or spools typically comprise a core provided with a pair of axially spaced annular flanges. It is common in the industry to prepare such reels by molding identical half sections which can be joined to provide a complete reel. The most convenient method of joining such half sections is by securing together mating core sections. In commercial practice these mating core sections are usually joined by use of a solvent adhesive. A typical such prior art spool is shown in U.S. Pat. No. 3,966,139 (Terpak, June 29, 1976) and U.S. Pat. No. 3,942,741 (Hussar et al, Mar. 9, 1976). While some efforts have been made to avoid use of adhesives and to employ welding, particularly ultrasonic welding, in assembling such reels, this has not achieved any commercial success due to the difficulty in transmitting the ultrasonic welding energy to the parting line of the mating core sections. For example, U.S. Pat. No. 4,607,806, (Yealy, Aug. 26, 1986) shows a welder head welding the end of a core to a reel flange. However, Yealy does not involve two identical plastic core sections which are joined adjacent the center of the core connecting the two ends of the reel. U.S. Pat. No. 3,334,841, (Burhop, Aug. 8, 1967) also mentions welding but does not describe how the welding is achieved.

SUMMARY OF THE INVENTION

In the present invention ultrasonic welding is used to join two sections of a reel by providing adjacent the end of each core section which is to be abutted to the adjacent core, an internal circumferential lip which extends transversely to the axis of the core. This lip and its corresponding internal transverse lip on the mating core half are positioned so that they abut each other and the facing lip surfaces are ultrasonically welded together by means of an appropriately dimensioned ultrasonic welding tool head which extends inside the core through openings provided in the end flange. Thus the ultrasonic welding energy is concentrated at the transverse lips and does not have to be transmitted through other portions of the core structure. Thus rapid and positive ultrasonic welding of the two pieces can be achieved to give a strong unitary structure.

DESCRIPTION OF THE PREFERRED EMBODIMENTS

Figure 1:
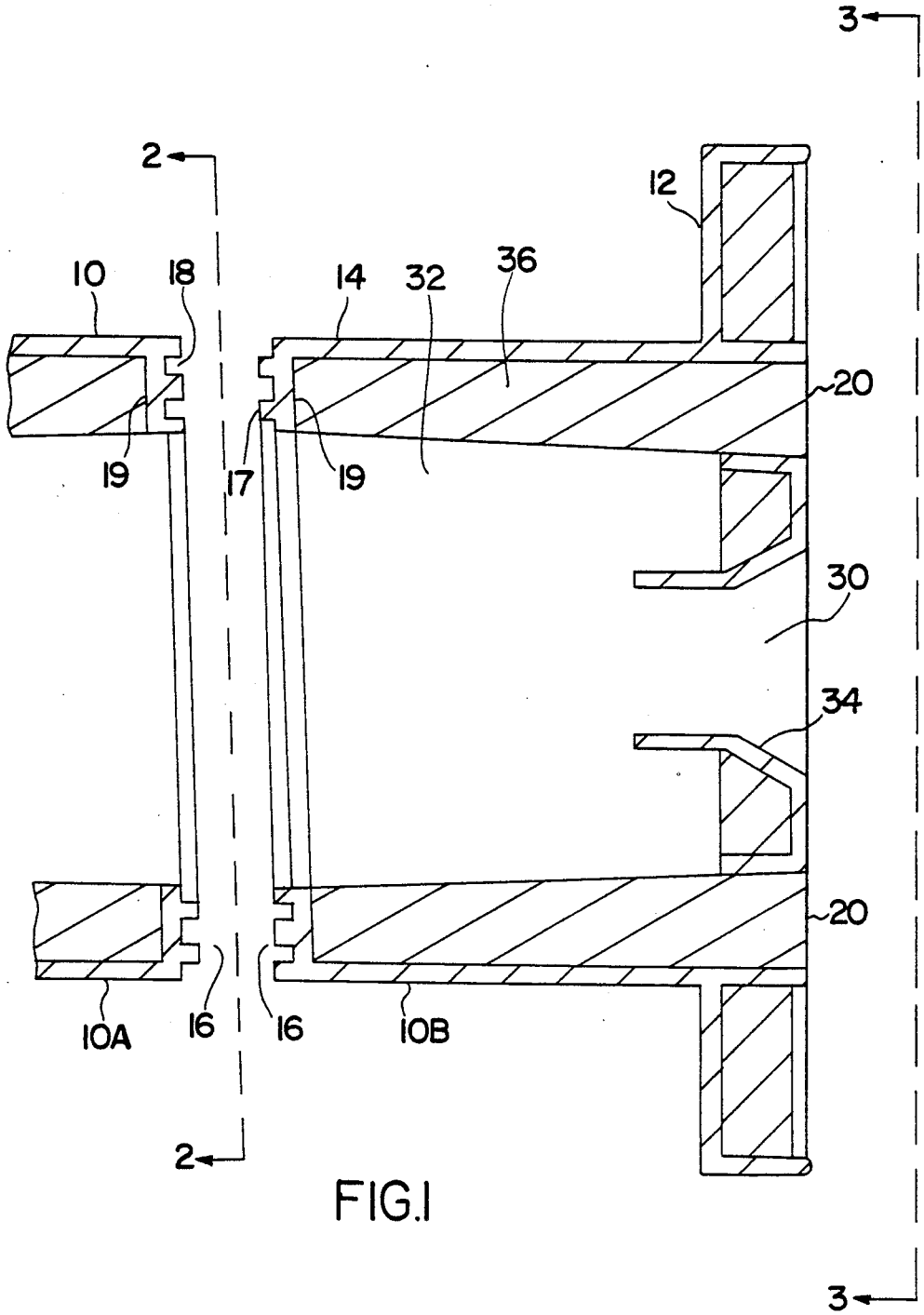
FIG. 1 is a partially schematic partially exploded view showing two halves of a reel assembly.

Referring now to FIG. 1, the reel is generally indicated 10 and preferably includes two identical halves 10A, 10B, each half comprising flange 12 and a core 14.

Figure 4:
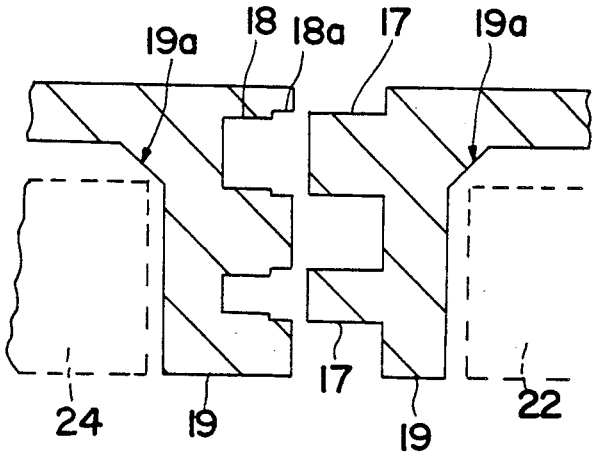
FIG. 4 is an enlarged diagrammatic partially sectional view of a preferred form of the interlocking lips and engaging mechanisms showing the ultrasonic welder and anvil in position to weld the two lips together.
Figure 3:
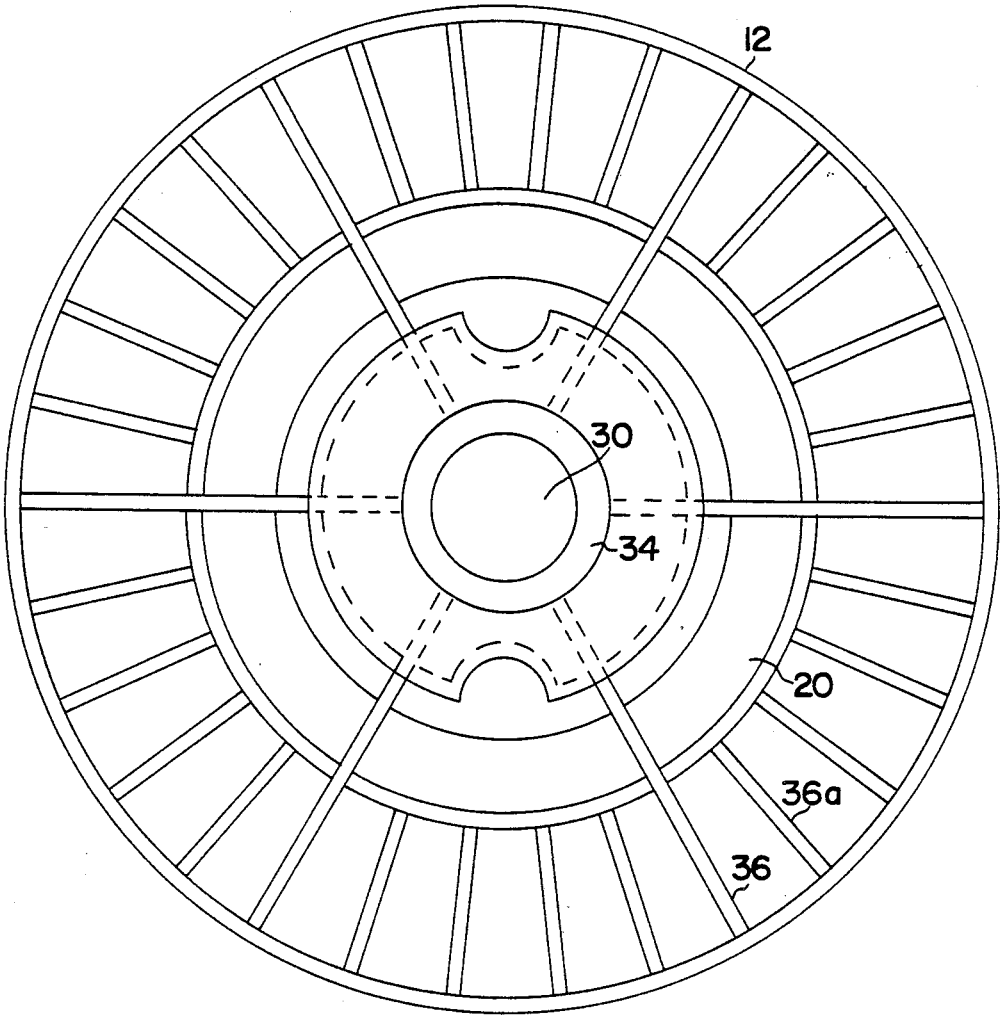
FIG. 3 is an end view of one of the halves along the line 3—3.

Adjacent the end of each core is an engaging means, generally indicated at 16 as comprising ridges 17 and grooves 18. In a preferred embodiment of the invention the groove 18 extends approximately 180° around the circumference of internally extending lip 19 and the ridge 17 extends the other 180° around the circumference. Thus by rotating halves 10A and 10B relative to one another the two halves will precisely match up as shown in FIG. 4.

Figure 2:
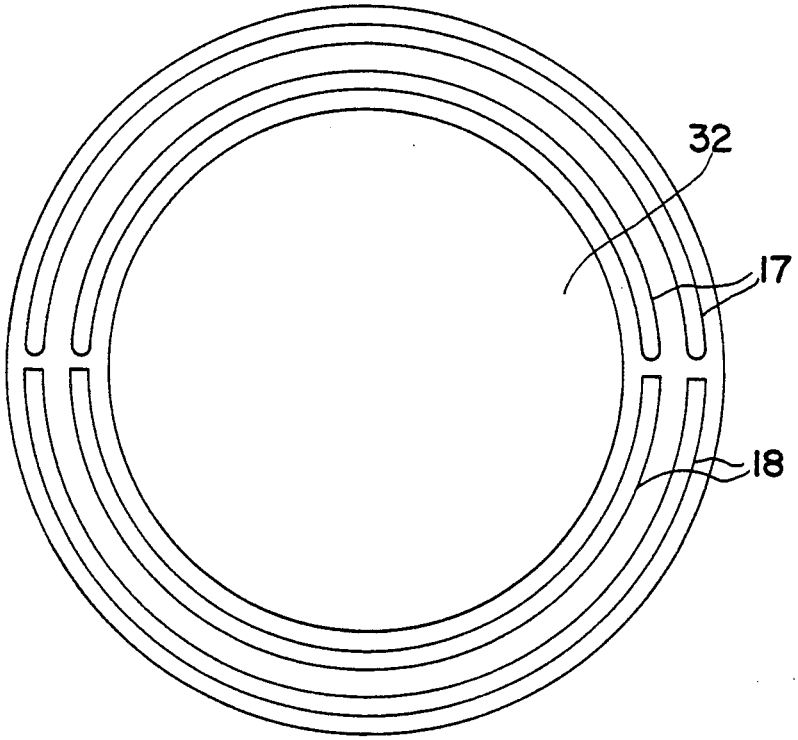
FIG. 2 is an end view of one of the halves along the line 2—2, omitting the flange.

This arrangement of the grooves and ridges is particularly shown in FIG. 2 which is an end view of the flange 19 and its integrally formed ridges 17 and grooves 18. As can be seen, the flange 12 is formed of integrally included hub 34, ribs 36 and **36*a* which reinforce the flange and is provided with openings 20 through which ultrasonic welding fingers 22 (see FIG. 4) can be inserted for achieving ultrasonic welding. There is also an axial hole 30 extending the length of the core. Reinforcing ribs 36** extend the length of the core to stiffen the core. The method of reinforcing such plastic spools is common in the art and its not a particular part of the present invention.

The important feature of the present invention is the internal and transversely extending lip inside of the core which carries the temporary connecting means comprising the cooperating grooves 18 and ribs 17. Grooves 18 and ribs 17 will hold the spool together in temporary assembly. Thus the assembled spool can then be mounted on an anvil (not shown) having fingers 24 which extend through the holes 20 to engage the backside of the lip 19. Ultrasonic welding fingers 22 are then inserted through the other half of the spool and ultrasonic energy is applied by fingers 22 to just the flanges 19 and their associated interlocking ridges and grooves 17 and 18. As will be noted, a preferred form of the invention (see FIG. 4) provides a stepped groove **18*a* which is just large enough to receive the mating ridge 17. The remainder of the groove 18 is narrower than the ridge 17 and is displaced during welding. A fillet 19*a* preferably underlying at least the outermost set of ridge and groove reinforces the back of each lip 19**. Sufficient energy is provided by the ultrasonic welding to sufficiently melt these interlocking components to thoroughly fuse these elements together into a single unitary structure. Thereafter the completed spool cannot be separated and has the same, or greater strength, as if it had been molded as a single piece.

The plastic used may be any conventional thermoplastic. Typical of such plastics are high impact polystyrene, medium impact polystyrene and ABS.

Various changes may be made in the above described invention without departing from the spirit and scope thereof. Thus, while the invention has been described employing identical half pieces this structure can be modified by having one piece slightly different than another. For example, one core can be longer or shorter or one core can have just the ridges and the other just the grooves. In another embodiment one piece may comprise one flange and the whole core and the other piece comprise just the second flange with ridges 17 and groove 18 for mating with the corresponding ridges and grooves carried by the abutting end of the core. However, from a manufacturing and tooling cost standpoint it is preferred that the spool is formed from identical half sections so that only one part need be manufactured for each spool.

Also, it is not necessary to mount the spool on an anvil for ultrasonic welding. All that is necessary is that the core piece not being energized by ultrasonic energy be held substantially fixed in position. Alternatively, both core pieces may be energized by means of appropriate ultrasonic tools.

I claim:

1. In a reel having a hollow core and two end flanges, said reel being formed of two plastic pieces each having one flange, said two pieces being arranged to abut in interlocking engagement preventing relative rotation of the two pieces around the core axis and holding said two portions temporarily together, the core of each piece having an internal lip adjacent its abutting end, said lip extending toward the core axis around a substantial portion of the core circumference, said lips providing two abutting surfaces and the flanges being arranged to permit access of ultrasonic welding means to bear on the back side of at least one of said abutting surfaces to apply axially exerting welding force to at least one of said pieces to permanently secure the two pieces together;

the improvement wherein each of said two abutting surfaces comprises a plurality of radially spaced partially circumferential grooves and ridges, said grooves and ridges having matching rectangular cross sections, the grooves on one lip being adapted to receive the ridges on the other lip when one piece is displaced a predetermined number of degrees around its axis with respect to the other piece, essentially all of the facing surface on each lip comprising either a part of a groove or a part of a ridge, whereby ultrasonic welding of said two pieces occurs around 360 degrees both radially along the abutting surfaces and axially in the grooves at the junction between said two pieces.

2. The reel of claim 1 wherein the back surfaces of the lips are provided with reinforcing fillets.

3. In a reel having a hollow core and two end flanges, said reel being formed of two plastic pieces each having one flange, said two pieces being arranged to abut in interlocking engagement preventing relative rotation of the two pieces around the core axis and holding said two portions temporarily together, the core of each piece having an internal lip adjacent its abutting end, said lip extending toward the core axis around a substantial portion of the core circumference, said lips providing two abutting surfaces and the flanges being arranged to permit access of ultrasonic welding means to bear on the back side of at least one of said abutting surfaces to apply axially exerting welding force to at least one of said pieces to permanently secure the two pieces together;

the improvement wherein each of said two abutting surfaces comprises a plurality of partially circumferential, radially spaced grooves and ridges, the grooves on one piece being adapted to receive the ridges on the other piece when the two pieces are predeterminedly oriented with respect to each other, each of the grooves having an opening which is wide enough to receive its facing ridge but becomes narrower than the ridge toward the bottom of the groove, essentially all of the facing surface on each lip comprising either a part of a groove or a part of a ridge, the mating grooves and ridges providing at least two circumferentially complete joints between the two lips, whereby ultrasonic welding of said two pieces occurs around 360 degrees both radially along the abutting surfaces and axially in the grooves at the junction between said two pieces.

4. The reel of claim 3 wherein the grooves have a stepped opening, only the outer portion of which is as wide as the facing ridge.

5. The reel of claim 3 wherein the back surfaces of the lips are provided with reinforcing fillets.

* * * * *